US005115925A

United States Patent [19]

Koizumi

[11] Patent Number: 5,115,925

[45] Date of Patent: May 26, 1992

[54] JIB STRETCHING AND FOLDING DEVICE FOR CRANE

[75] Inventor: Yukio Koizumi, Akashi, Japan

[73] Assignee: Kabushiki Kaisha Kobe Seiko Sho, Kobe, Japan

[21] Appl. No.: 521,368

[22] Filed: May 10, 1990

[30] Foreign Application Priority Data

Aug. 10, 1989 [JP] Japan ..... 1-208504
Jan. 8, 1990 [JP] Japan ..... 2-2055

[51] Int. Cl.[5] ..... B66C 23/70

[52] U.S. Cl. ..... 212/266; 212/188; 212/187

[58] Field of Search ..... 212/266, 227, 231, 232, 212/237, 238≧239, 255, 260–262, 187, 188; 52/115–119

[56] References Cited

U.S. PATENT DOCUMENTS

| | | | |
|---|---|---|---|
| 3,339,463 | 9/1967 | Updegrove | 212/231 |
| 4,483,447 | 11/1984 | Bernabe, Jr. | 212/188 |
| 4,658,972 | 4/1987 | Koizumi et al. | 212/270 |
| 4,828,124 | 5/1989 | Igg | 212/188 |
| 4,953,724 | 9/1990 | Koizumi | 212/188 |
| 4,967,917 | 11/1990 | Koizumi et al. | 212/188 |

FOREIGN PATENT DOCUMENTS

| | | | |
|---|---|---|---|
| WO-1440 | 5/1981 | World Int. Prop. O. | 212/227 |

*Primary Examiner*—Edwin L. Swinehart
*Attorney, Agent, or Firm*—Oblon, Spivak, McClelland, Maier & Neustadt

[57] ABSTRACT

A jib stretching and folding device including an auxiliary connector mounted on a lower surface of a jib in the vicinity of a base end portion ofo the jib in a jib folded condition. The auxiliary connector includes a cylindrical housing fixed to the lower surface of the jib and a connecting rod rotatably supported by the housing and having an axis which is substantially parellel to the lower surface of the jib. The jib is twisted about the axis of the connecting rod to effect a jib stretching or folding operation. A twist guiding groove is formed on one of the housing and the connecting rood of the auxiliary connector, and an engagement projection is provided on the other of the housing and the connecting rod to engage the twist guiding groove. When the jib is raised or lowered by a jib raising/lowering means, the engagement projection is moved in the twist guiding groove to generate a jib twisting force. Thus, the jib is automatically twisted in the jib stretching or folding operation. Accordingly, a burden of labor of an operator in stretching and folding the jib can be reduced. Further, the operation can be made continuous to thereby improve the efficiency of the jib stretching and folding operation.

18 Claims, 16 Drawing Sheets

JIB STRETCHING AND FOLDING DEVICE FOR CRANE

BACKGROUND OF THE INVENTION

1. Field of the Invention

The present invention relates to a jib stretching and folding device in a wheel type crane such as a truck crane and a rough terrain crane for stretching and folding a jib in a so-called jib twisting operation wherein the jib is twisted.

2. Background of the Related Art

Such a jib stretching and folding device adopting the jib twisting, operation is described in Japanese Patent Publication No. 63-3827 and Japanese Utility Model Laid-open Publication No. 63-173185, for example. In this prior art, the jib is so folded as to be vertically disposed and laid aside a side surface of a boom. A jib stretching operation is carried out by the steps of suspending the jib in the above-mentioned folded position, then twisting the jib about a vertical axis by about 270°, then raising the jib, and finally stretching the jib from a forward end of the boom. In contrast, a jib folding operation is carried out by the steps of lowering the jib from the stretched position, then twisting the jib, and then drawing the jib toward the side surface of the boom.

However, in the prior art device as described in the above cited references, the jib twisting step in the stretching or folding operation is manually carried out. Accordingly, in case of a large jib to be used in a large crane, the twisting operation of the jib is troublesome. Furthermore, since such a manual operation for twisting the jib is necessary during the course of the jib stretching or folding operation, the stretching or folding operation cannot be made continuous.

SUMMARY OF THE INVENTION

It is an object of the present invention to provide a jib stretching and folding device for a crane which can automatically twist a jib.

According to the present invention, there is provided a jib stretching and folding device for a crane comprising a boom having a forward end portion provided with first and second jib mounting shafts projecting oppositely from opposite side surfaces of said forward end portion; a jib having a base end portion provided with first and second jib foots adapted to be detachably connected to said first and second jib mounting shafts, respectively; wherein when said jib is in a folded condition, said jib is positioned next to a side surface of the boom under the condition where said first jib foot is positioned under said second jib foot, while when said jib is in a stretched condition, said jib extends forwardly from said forward end portion of said boom under the condition where said first and second jib feet are connected to said first and second jib mounting shafts, respectively; an auxiliary connector mounted on a lower surface of said jib in the vicinity of said base end poriton of said jib under the jib folded condition, said auxiliary connector comprising a cylindrical housing fixed to said lower surface of said jib and a connecting rod supported to said housing in such a manner as to be rotatable about an axis of said connecting rod substantially parallel to said lower surface of said jib and to be movable along, said axis of said connecting rod; wherein said jib stretched condition is obtained by the steps of connecting said connecting rod to said first jib mounting shaft to which said first jib foot is to be connected, then suspending said jib from a connection point between said connecting rod and said first jib mounting shaft, then twisting said jib about said axis of said connecting rod at a predetermined twisting angle in a first direction, and then raising said jib to connect said first and second jib feet to said first and second jib mounting shafts, respectively, while said jib folded condition is obtained by the steps of lowering said jib to disconnect said first and second jib feet from said first and second jib mounting shafts, respectively, then twisting said jib about said axis of said connecting rod at said predetermined angle in a second direction counter to said first direction, and then drawing said jib to the side surface of said boom; a twist guiding groove formed on one of said housing and said connecting rod of said auxiliary connector; an engagement projection provided on the other of said housing and said connecting rod to engage said twist guiding groove; said twist guiding groove comprising a spiral groove portion extending in a direction corresponding to said jib twisting direction and formed in a circumferential angular range corresponding to said jib twisting angle in said jib twisting step, and a straight groove portion having a length corresponding to a raising quantity and a lowering quantity of said jib in said jib raising step and said jib lowering step, respectively; and jib raising/lowering means for raising and lowering said jib in said jib twisting step to move said engagement projection in said twist guiding groove.

With this construction, the jib stretching and folding device includes the auxiliary connector mounted on the lower surface of the jib in the vicinity of the base end portion of the jib under the jib folded condition. The auxiliary connector includes the cylindrical housing fixed to the lower surface of the jib and the connecting rod supported to the housing in such a manner as to be rotatable about the axis of the connecting rod substantially parallel to the lower surface of the jib and to be movable along the axis of the connecting rod. The jib is twisted about the axis of the connecting rod to effect a jib stretching or folding operation. The twist guiding groove is formed on one of the housing and the connecting rod of the auxiliary connector, and the engagement projection is provided on the other of the housing and the connecting rod to engage the twist guiding groove. When the jib is raised or lowered by the jib raising/lowering means, the engagement projection is moved in the twist guiding groove to generate a jib twisting force. Thus, the jib is automatically twisted in the jib stretching or folding operation. Accordingly, a burden of labor of an operator in stretching and folding the jib can be reduced. Further, the operation can be made continuous to thereby improve the efficiency of the jib stretching and folding operation.

According to another aspect of the present invention, either of said housing or said connecting rod of said auxiliary connector is provided with an arcuate guide plate having said twist guiding groove, and the other of said housing and said connecting rod is provided with said engagement projection.

With this construction, the arcuate guide plate can be easily formed by cutting a flat plate to form the twist guiding groove and then arcuately bending the flat plate. Accordingly, as compared with the case where the twist guiding groove is formed on a cylindrical body (the connecting rod or the cylindrical housing), the formation of the twist guiding groove can be easily carried out.

According to a further aspect of the present invention, in the above construction employing the arcuate guide plate, said auxiliary connector is constructed of a hydraulic cylinder having a cylinder tube as said housing and a piston rod as said connecting rod, and said jib raising/lowering means is constructed of said hydraulic cylinder.

With this construction, as the auxiliary connector serves as the jib raising/lowering means, a jib raising/-lowering force is applied on the axis of the auxiliary connector. Accordingly, as compared with the case where a whip rope is used as the jib raising/lowering means, the jib can be raised more smoothly and stably.

Other objects and features of the invention will be more fully understood from the following detailed description and appended claims when taken with the accompanying drawings.

DETAILED DESCRIPTION OF THE PREFERRED EMBODIMENTS

Figure 1:
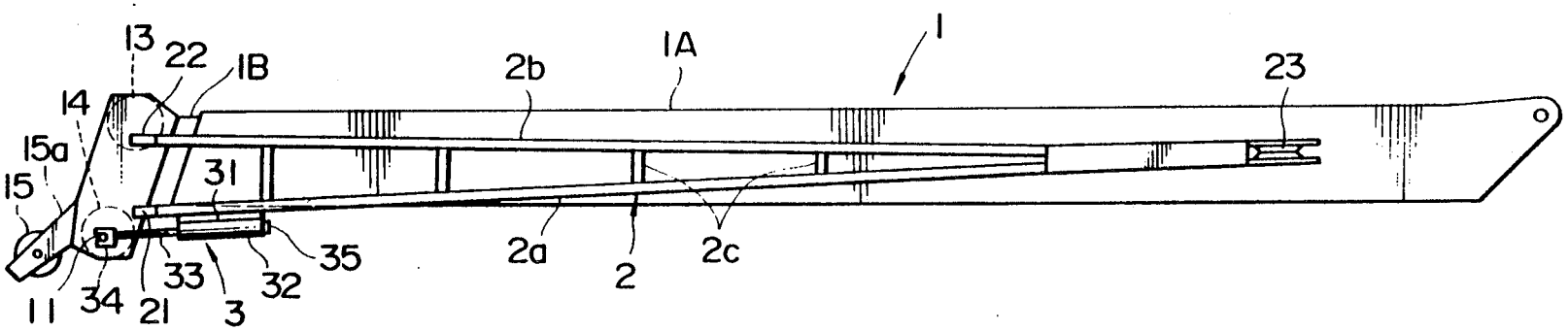
FIG. 1 is a side view of the jib under the folded condition according to a first preferred embodiment of the present invention.

There will now be described some preferred embodiments of the present invention with reference to the drawings.

(1) FIRST PREFERRED EMBODIMENT (SEE FIGS. 1 TO 10)

Reference numerals 1 and 2 generally designate a telescopic boom and a jib, respectively.

The boom 1 is normally constructed of a base boom and multi-stage movable booms. For better understanding, the boom 1 shown is of a two-stage boom constructed of a base boom 1A pivotably supported to a body of a crane and a single-stage movable 1B telescopically supported to the base boom 1A.

As well known, the jib 2 has a tapering ladder-like structure constructed of left and right beams **2*a* and 2*b* (the terms "left" and "right" will be hereinafter defined as viewed from an operator cab under the stretched condition of the jib) and a plurality of cross bars 2*c* connecting the beams 2*a* and 2*b***.

The movable boom 1B is provided at its forward end portion with left and right jib mounting shafts 11 and 12 projecting horizontally. The left jib mounting shaft 11 is constructed of a main mounting portion **11*a* having a length equal to that of the right jib mounting shaft 12 and an auxiliary mounting portion 11*b* integrally extending from the main mounting portion 11*a* (see FIGS. 5, 6 and 8). There are provided at the forward end portion of the movable boom 1B an idler sheave 13, a main sheave 14 and an auxiliary sheave 15 mounted through an auxiliary sheave bracket 15*a* to the forward end portion of the movable boom 1B**.

Figure 8:
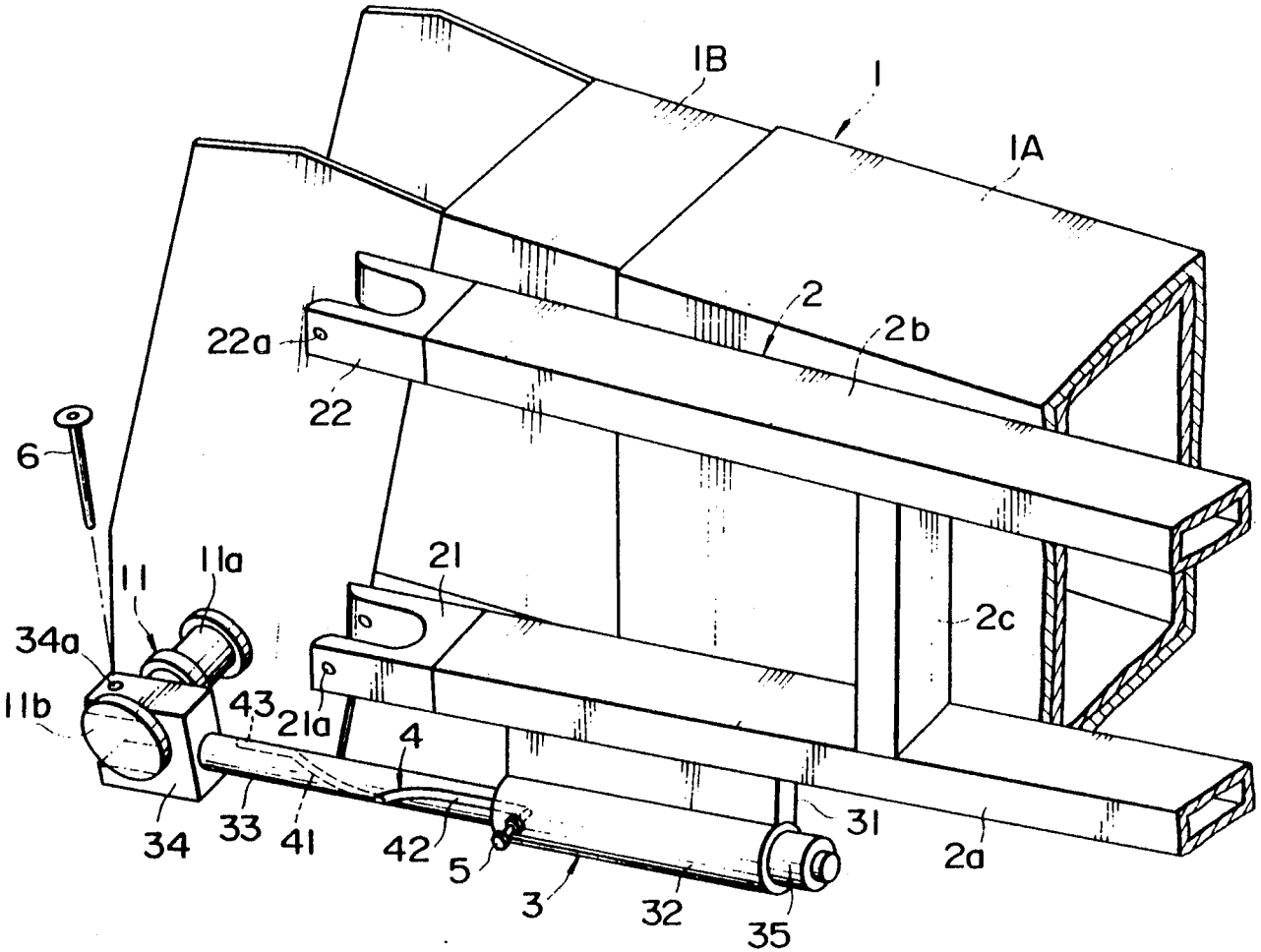
FIG. 8 is an enlarged perspective view of an essential part in FIG. 1.
Figure 9:
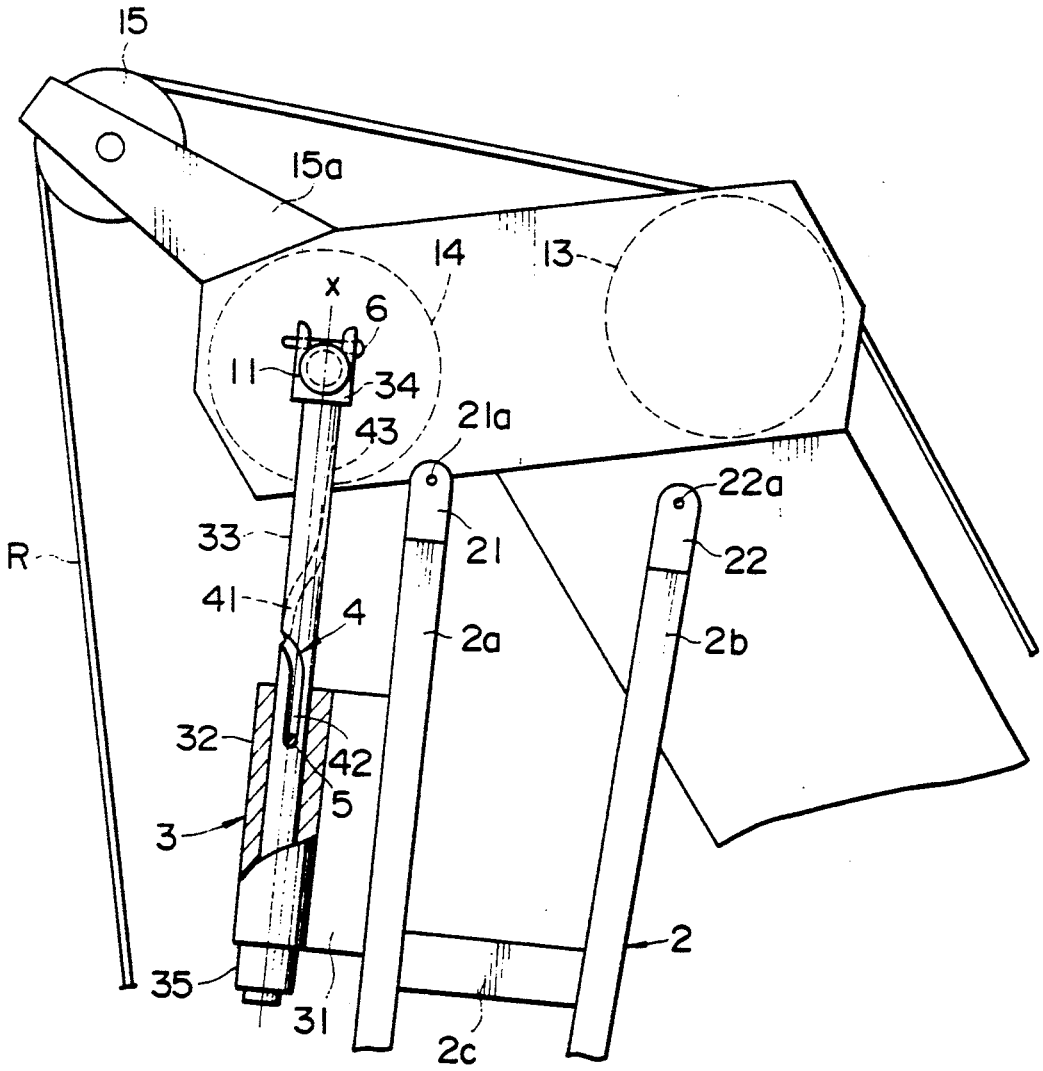
FIG. 9 is an enlarged side view, partially in section, of an essential part in FIG. 2.

As best shown in FIGS. 8 and 9, a pair of left and right forked jib foots 21 and 22 are fixed to base ends of the left and right beams **2*a* and 2*b* of the jib 2, respectively. The jib foots 21 and 22 are formed with fixing pin holes 21*a* and 22*a***, respectively, for inserting fixing pins (not shown) thereinto.

Figure 7:
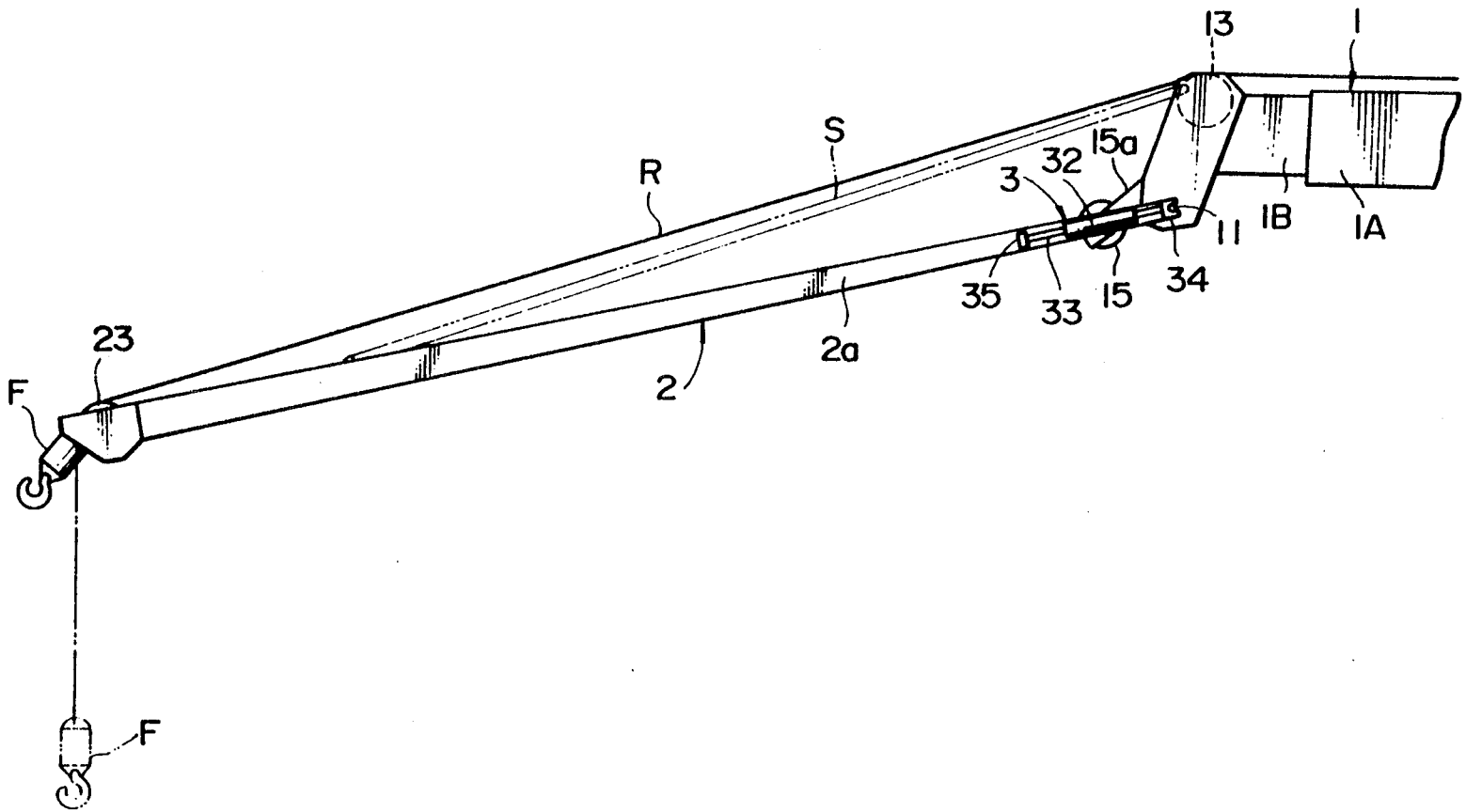
FIG. 7 is a side view of the jib under the stretched condition.

In a using (extended) condition of the jib 2 as shown in FIG. 7, the jib feet 21 and 22 are engaged with the jib mounting shafts 11 and 12, respectively, and the jib 2 is so disposed as to extend from the forward end of the movable boom 1B. On the other hand, in an unusing (folded) condition of the jib 2 as shown in FIG. 1, the jib 2 is so disposed as to extend along the left side surface of the boom 1 under a vertical condition such that the left beam **2*a* and the left jib foot 21 are positioned under the right beam 2*b* and the right jib foot 22, and the jib 2** is fixed by known fixing means (not shown).

Under the folded condition of the jib 2 as shown in FIG. 1, an auxiliary connector 3 is fixed to a lower surface of the left (lower) beam **2*a* of the jib 2** at a position near the base end portion thereof.

The auxiliary connector 3 includes a cylindrical housing 32 fixed through a bracket 31 to the left beam **2*a* and a connecting rod 33 axially inserted through the housing 32**.

The connecting rod 33 is disposed below the left beam **2*a* in parallel relationship thereto when the jib is in its folded condition, and it is supported to the housing 32 in such a manner as to be rotatable about an axis x of the rod 33 (see FIGS. 2 and 9**) and be slidable along the axis x.

The connecting rod 33 is provided at its one end corresponding to the base end of the jib 2 with a connecting member 34 forked like the jib feet 21 and 22, and is also provided at the other end with a stopper 35. When the stopper 35 is in abutment against an end surface of the housing 32 at the opposite end from the connecting member 34, the connecting rod 33 projects at the maximum toward the base end of the jib 2 (which condition will be hereinafter referred to as an advance condition). When the connecting rod 33 is slid from this advance condition toward the forward end of the jib 2, a retract condition of the connecting rod 33 is obtained. Under the advance condition, the connecting member 34 is disposed at a position projecting from the left (lower) jib foot 21 leftwardly as viewed in FIG. 1, and is engageable with the auxiliary mounting portion 11*b* of the left jib mounting shaft 11. As shown in FIG. 8, the connecting member 34 is formed at its forked portion with a pair of pin holes 34*a* for inserting a fixing pin 6 thereinto.

As shown in FIGS. 8 and 9, a twist guiding groove 4 is formed on an outer circumferential surface of the connecting rod 33, and a guide pin 5 is fixedly mounted to the housing 32 in such a manner as to be inserted through a cylindrical wall of the housing 32 and be engaged at its inner end with the twist guiding groove 4.

Figure 10:
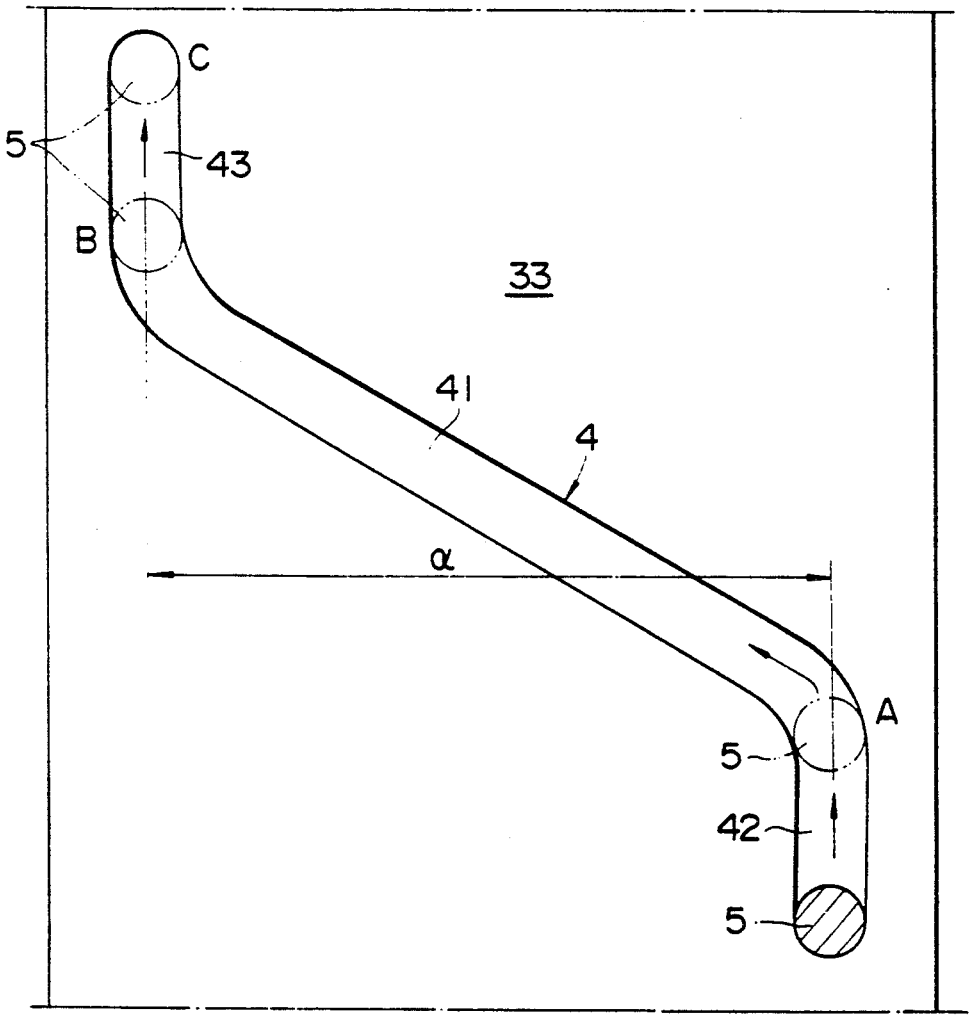
FIG. 10 is an enlarged development of a part of the connecting rod formed with the twist guiding groove.

As shown in FIG. 10, the twist guiding groove 4 includes a spiral groove portion 41 formed spirally on the outer circumferential surface of the connecting rod 33 in a predetermined circumferential angular range $\alpha$ (about 270°) corresponding to a jib twisting angle in the jib stretching operation and the jib folding operation, and of first and second straight groove portions 42 and 43 continuing from opposite ends of the spiral groove portion 41 in the axial direction of the connecting rod 33.

The operation of the first preferred embodiment will now be described.

(I) JIB STRETCHING OPERATION

The jib 2 is stretched from the folded position shown in FIG. 1 via the following steps to the stretched (extended) position shown in FIG. 7.

(I)-1 Preparing Step

As shown in FIG. 1, the boom 1 is fully contracted, and is laid substantially horizontally. Under the condition, the connecting rod 33 is advanced to engage the connecting member 34 with the auxiliary mounting portion 11*b* of the left jib mounting shaft 11. Then, the fixing pin 6 is inserted into the pin holes 34*a* of the connecting member 34, so as to connect the connecting member 34 disengageably and rotatably with respect to the shaft.

At this time, the guide pin 5 is positioned at a closed end of the first straight groove portion 42 of the twist guiding groove 4 as shown by a solid line in FIG. 10.

(I)-2 Jib Suspending Step

Figure 2:
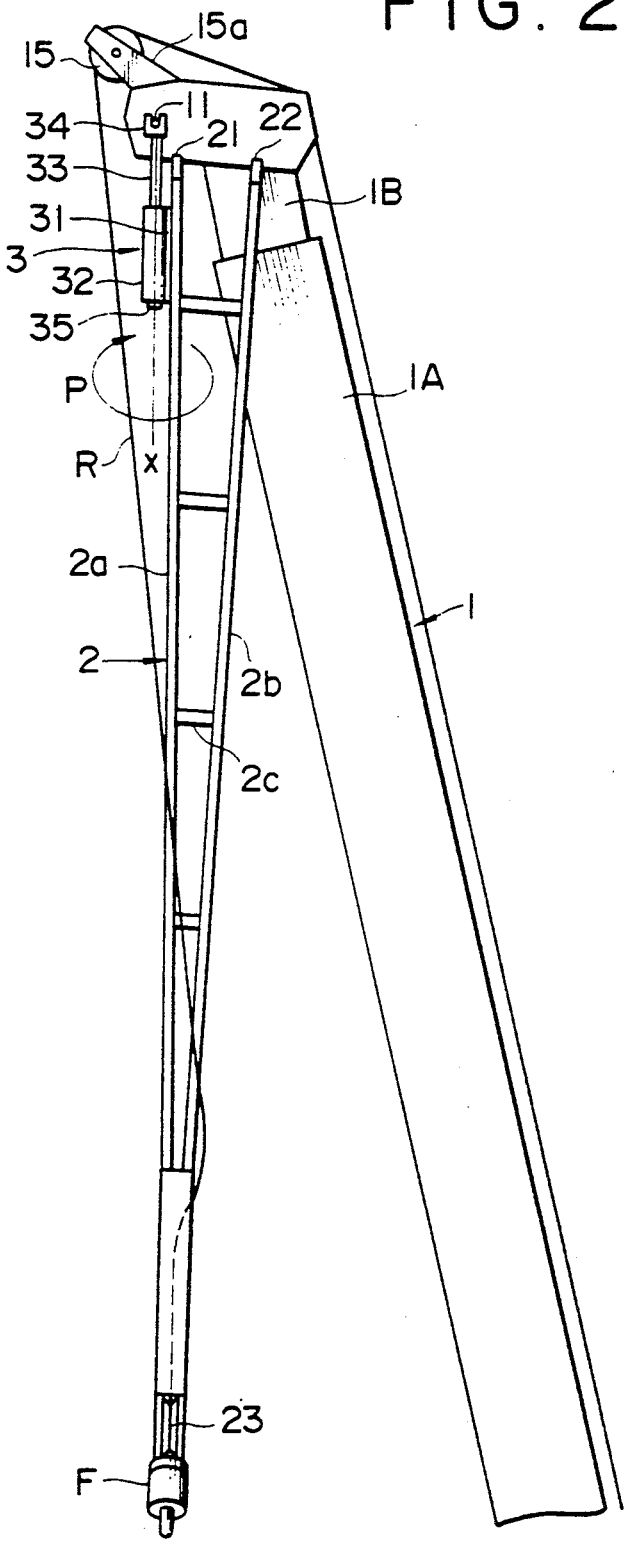
FIG. 2 is a side view of the jib under the suspended condition in the jib stretching operation.

As shown in FIG. 2, the boom 1 is derricked up to suspend the jib 2 from a connection point between the connecting member 34 and the left jib mounting shaft 11. Such a jib suspending step is automatically carried out by the combination of an expanding operation of the boom 1 and a guiding operation of a know jib guiding mechanism as described in Japanese Patent Publication No. 63-3827 mentioned previously, for example. As will be hereinafter described, a jib drawing step in the jib folding operation is also automatically carried out by the combination of a contracting operation of the boom 1 and the guiding operation of the above-mentioned jib guiding mechanism.

(I)-3 Jib Twisting Step

Figure 3:
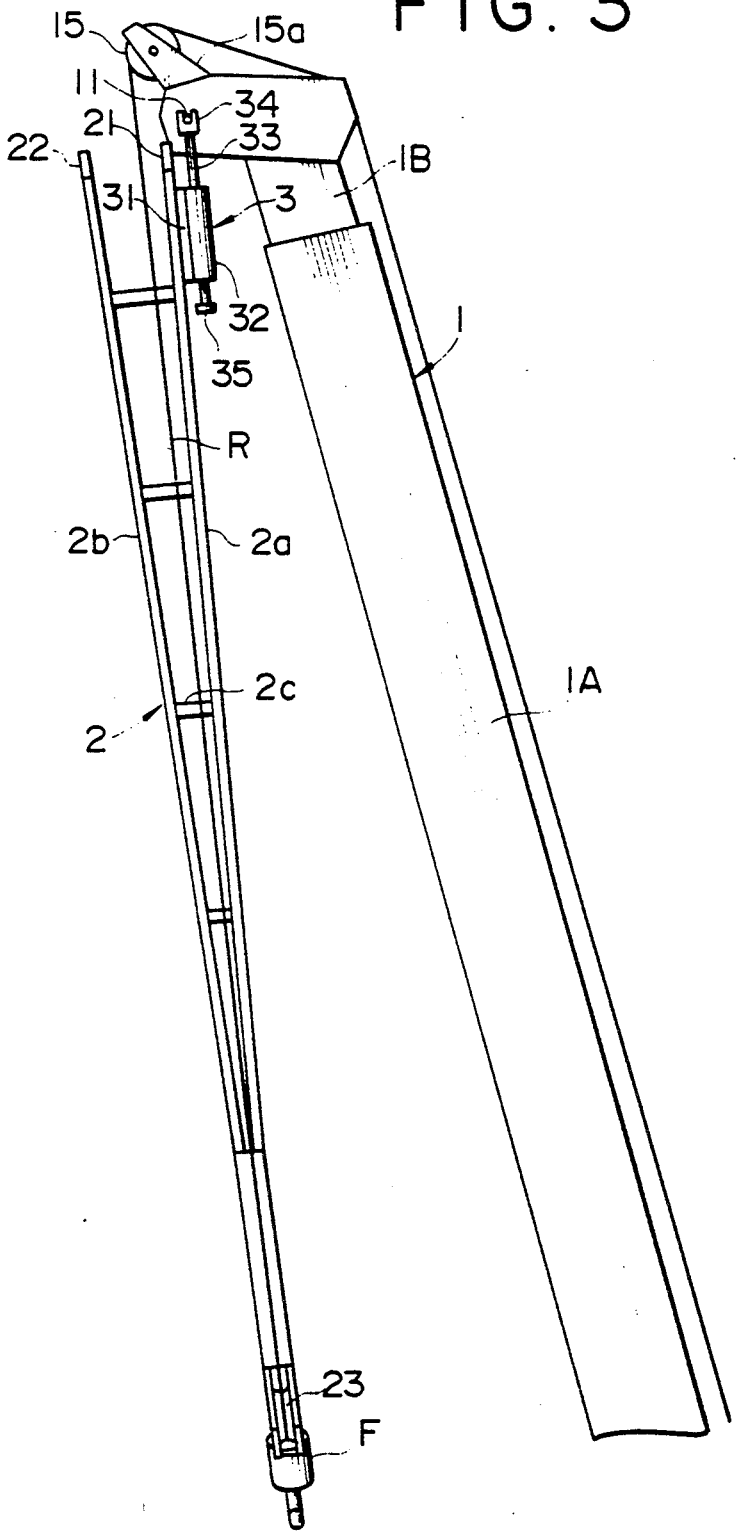
FIG. 3 is a side view of the jib at a midway position during the jib twisting step in the jib stretching operation.

After the jib suspending step, a whip rope R for crane operation preliminarily taken out from a winch (not shown) and wound on the auxiliary sheave 15 is wound on a guide sheave 23 mounted at the forward end of the jib 2, and a hook F fixed to an end of the whip rope R is engaged with the forward end of the jib 2. In winding the whip rope R on the guide sheave 23, the whip rope R is turned to the rear side of the jib 2 as shown in FIG. 2, so that the jib 2 may be laid aside the front side of the jib 2 after the completion of the jib twisting step as shown in FIG. 3.

Then, the whip rope R is taken up (or the boom 1 is normally expanded under the fixed condition of the whip rope R). As a result, the jib 2 is raised by the hoisting force of the whip rope R. Accordingly, the housing 32 of the auxiliary connector 3 integral with the jib 2 is also raised (i.e., the connecting rod 33 is relatively retracted), with the result that the guide pin 5 is moved from the closed end of the first straight groove portion 42 through a first connection point between the first straight groove portion 42 and the spiral groove portion 41 as shown by a phantom line A in FIG. 10 to a second connection point between the spiral groove portion 41 and the second straight groove portion 43 as shown by a phantom line B in FIG. 10.

Figure 4:
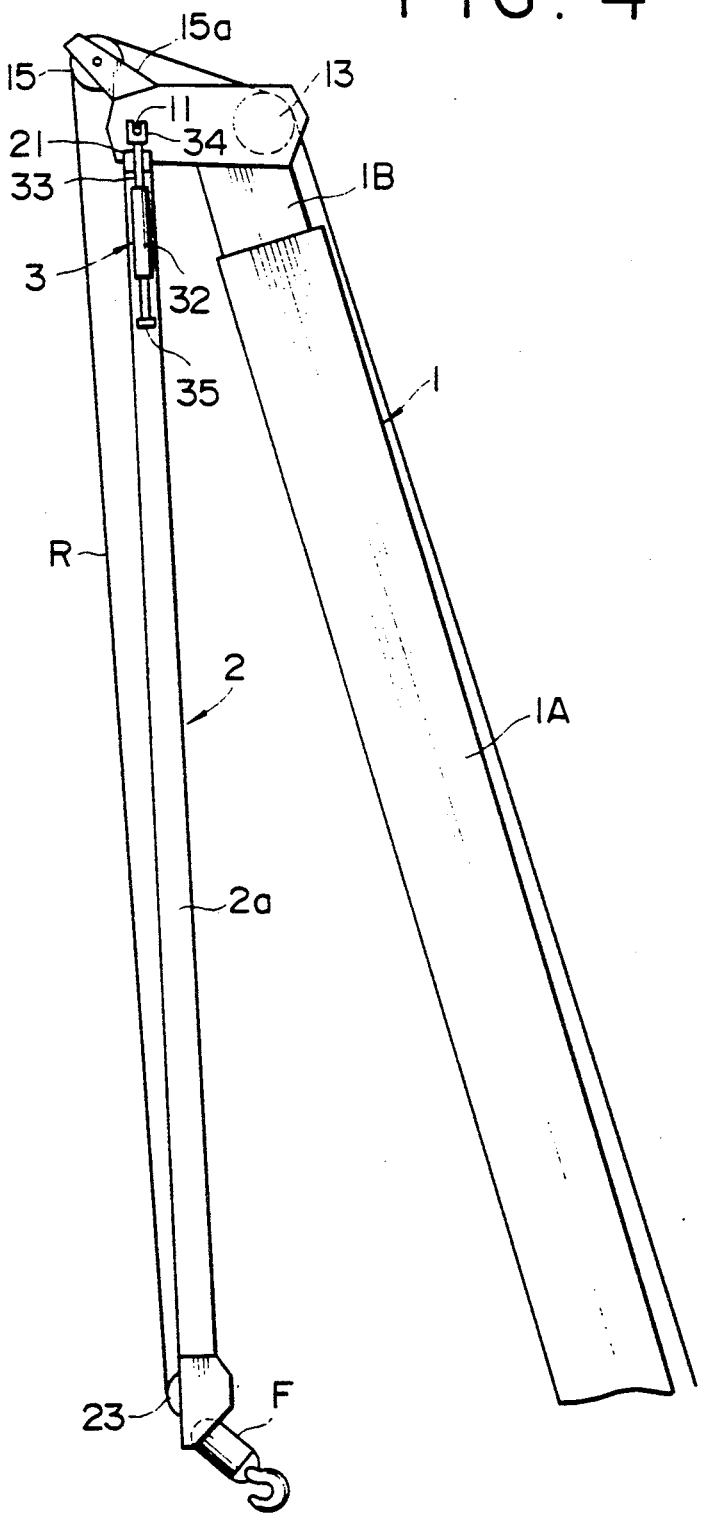
FIG. 4 is a side view of the jib at the end of the jib twisting step.
Figure 5:
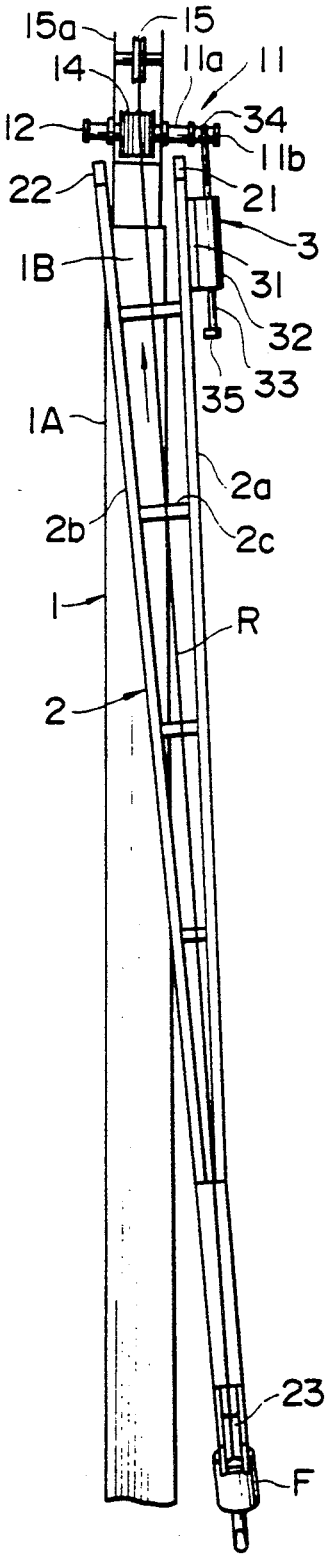
FIG. 5 is an elevational view of FIG. 4.

Such a movement of the guide pin 5 guided by the spiral groove portion 41 causes twisting of the jib 2 at about 270° about the axis x of the connecting rod 33 in a direction shown by an arrow P in FIG. 2 at the same time of raising of the jib 2. FIG. 2 shows the condition before the jib 2 is twisted; FIG. 3 shows the condition where the jib 2 has been twisted at about 180 ° from the condition of FIG. 2; and FIGS. 4 and 5 show the condition where the jib 2 has been further twisted at about 90° from the condition of FIG. 3, and the jib foots 21 and 22 have come to a position just below the jib mounting shafts 11 and 12, respectively.

(I)-4 Jib Raising Step

Figure 6:
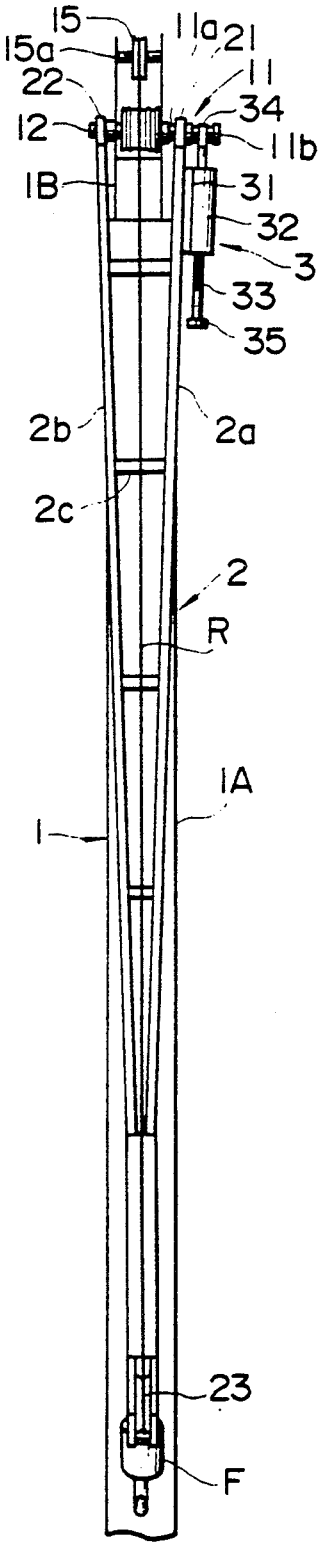
FIG. 6 is an elevational view of the jib raised vertically from the position shown in FIG. 5.

After the jib twisting step, the jib 2 is further raised by taking up the whip rope R until the left jib foot 21 comes into engagement with the main mounting portion 11*a* of the left jib mounting shaft 11, and the right jib foot 22 comes into engagement with the right jib mounting shaft 12 as shown in FIG. 6. In this raising step, the guide pin 5 is moved from the connection point between the spiral groove portion 41 and the second straight groove portion 43 as shown by the phantom line B in FIG. 10 to a closed end of the second straight groove portion 43 as shown by a phantom line C in FIG. 10. That is, the second straight groove portion 43 has a length corresponding to the distance the jib 2 is raised in the jib raising step.

(I)-5 Jib Swinging-up Step

After the jib raising step, the whip rope R is further taken up to swing up the jib 2 about the jib mounting shafts 11 and 12, and simultaneously the boom 1 is derricked down to a substantially horizontal position to obtain the condition shown in FIG. 7.

In the extended condition, the jib feet 21 and 22 are fixed to the jib mounting shafts 11 and 12 by inserting fixing pins (not shown into the pin holes 21*a* and 22*a* of the jib feet 21 and 22, respectively. Further, a suspension rod S as shown by a phantom line in FIG. 7 is mounted between the jib 2 and the forward end of the boom 1.

Thus, the stretching operation of the jib 2 is completed.

(II) JIB FOLDING OPERATION

The folding operation of the jib 2 is carried out along a procedure reversed relative to that of the above-mentioned stretching operation. That is, the jib 2 is first swung down from the position shown in FIG. 7 to the position shown in FIG. 6 (jib swinging-down step). Then, the jib 2 is lowered to the position shown in FIGS. 4 and 5 (jib lowering step). Then, the jib 2 is twisted by about 270° in a direction reversed to that in the stretching operation to obtain the condition shown in FIG. 2 (jib twisting step). Finally, the jib 2 is drawn to a position adjacent to the side surface of the boom 1 (jib drawing step). Thus, the jib 2 is folded aside the boom 1.

In the jib lowering step and the jib twisting step in the folding operation to be carried out by unwinding the whip rope R, the guide pin 5 is moved from the second straight groove portion 43 via the spiral groove portion 41 of the twist guiding groove 4, thus effecting automatic twisting of the jib 2.

Since the guide pin 5 is positioned in the first straight groove portion 42 of the twist guiding groove 4 after the completion of the jib twisting step, there is no possibility that the jib 2 will be twisted in the jib drawing step.

(2) SECOND PREFERRED EMBODIMENT (SEE FIGS. 11 AND 12)

In the construction of the first preferred embodiment wherein the jib 2 is twisted at about 270°, there is a possibility that the jib 2 will be damaged by the whip rope R because the whip rope R is taken up under the condition where it is entangled with the jib 2 in the twisting step as shown in FIG. 2.

Further, the spiral groove portion 41 of the twist guiding groove 4 must be formed in the angular range of about 270° ($\frac{3}{4}$ of the circumference of the connectiong rod 33), and a spiral angle of the spiral groove portion 41 must be sufficiently large so as to reduce a twisting resistance. Accordingly, a length of the connecting rod 33 on which the twist guiding groove 4 is formed becomes large to cause an increase in cost and weight.

Figure 11:
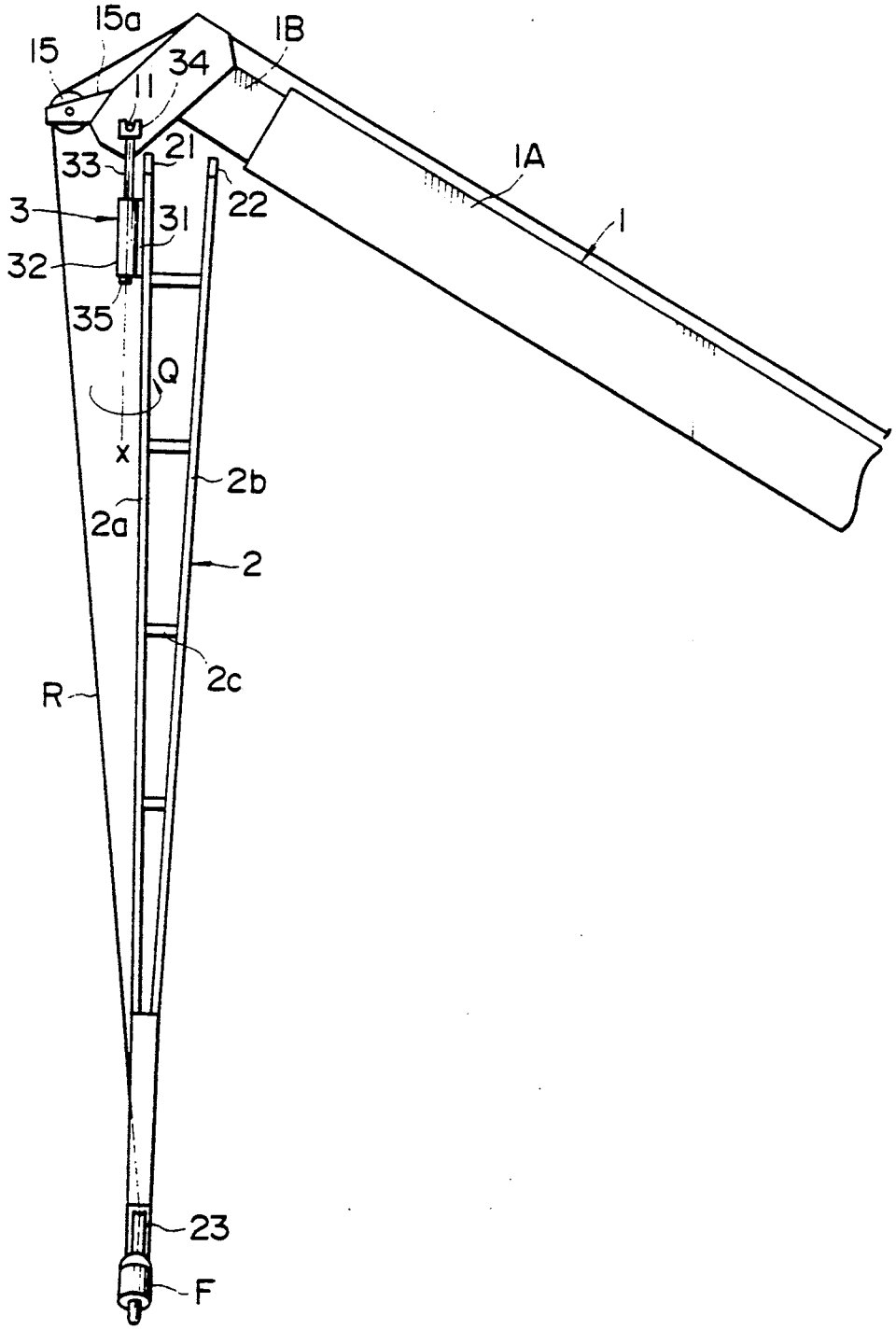
FIG. 11 is a side view similar to FIG. 2, showing a second preferred embodiment.
Figure 12:
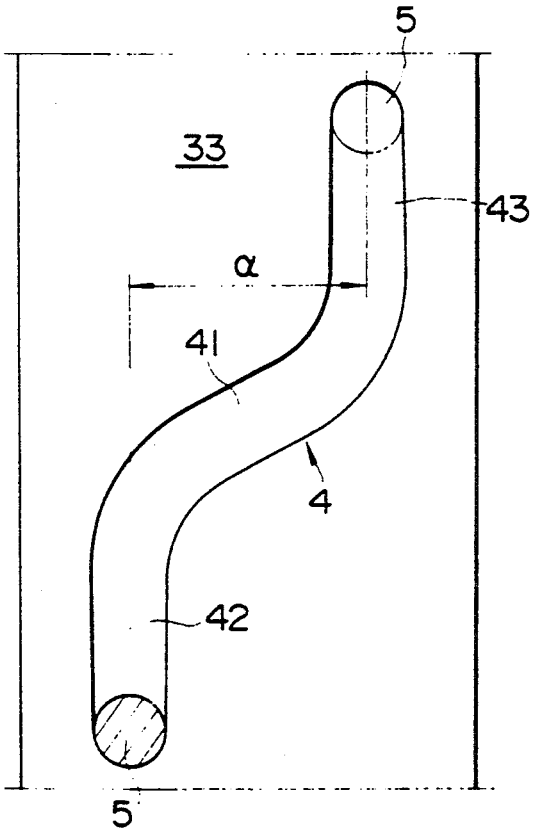
FIG. 12 is a view similar to FIG. 10, showing the second preferred embodiment.

To cope with this, the second preferred embodiment is constructed in such a way that the spiral groove portion 41 of the twist guiding groove 4 is formed in a circumferential angular range of about 90° ($\alpha=90°$) as shown in FIG. 12, and that the jib 2 is twisted at about 90° in a direction shown by an arrow Q in FIG. 11 in the jib stretching operation, the direction being opposite to the twisting direction in the first preferred embodiment. The other construction is the same as that in the first preferred embodiment.

With this construction, the whip rope R is directly wound on the guide sheave 23 mounted at the forward end of the jib 2 without being turned to the rear side of the jib 2. Accordingly, there is no possibility that the jib 2 will be damaged by the whip rope R in the twisting step. Further, as the angular range $\alpha$ of the twist guiding groove 4 is reduced to $\frac{1}{3}$ of that in the first preferred embodiment, the length of the connecting rod 33 can be reduced. Accordingly, the weight of the connecting rod 33 can be reduced.

(3) THIRD PREFERRED EMBODIMENT (SEE FIGS. 13 AND 14)

The formation of the twist guiding groove 4 on the outer circumferential surface (cylindrical surface) of the connecting rod 33 as in the first and second preferred embodiments is more troublesome and causes a higher machining cost than the formation of the twist guiding groove through a flat plate. Further, a diameter of the connecting rod 33 must be increased so as to compensate a reduction in strength due to the formation of the groove 4. As a result, the weight of the connecting rod 33 is increased.

Figure 13:
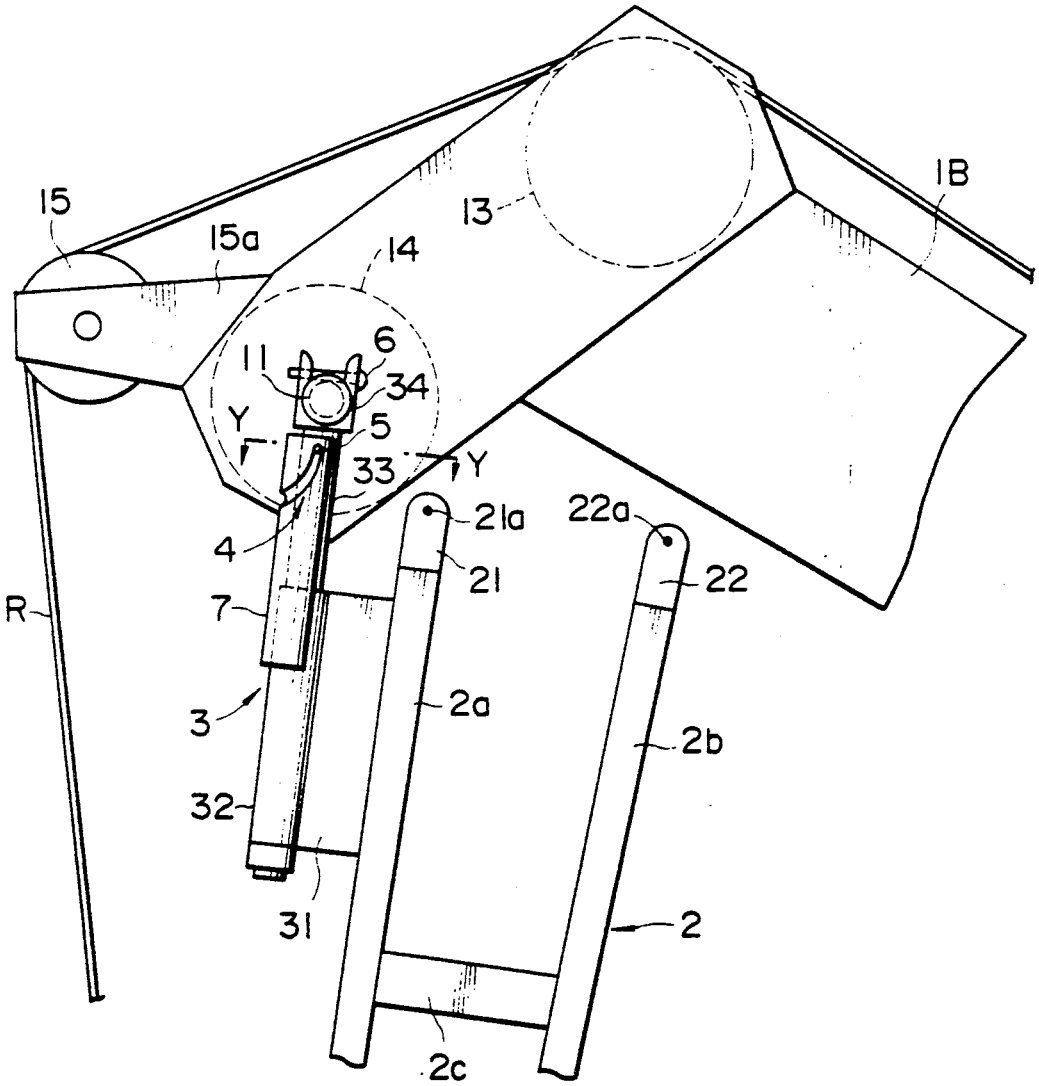
FIG. 13 is a view similar to FIG. 9, showing a third preferred embodiment.
Figure 14:
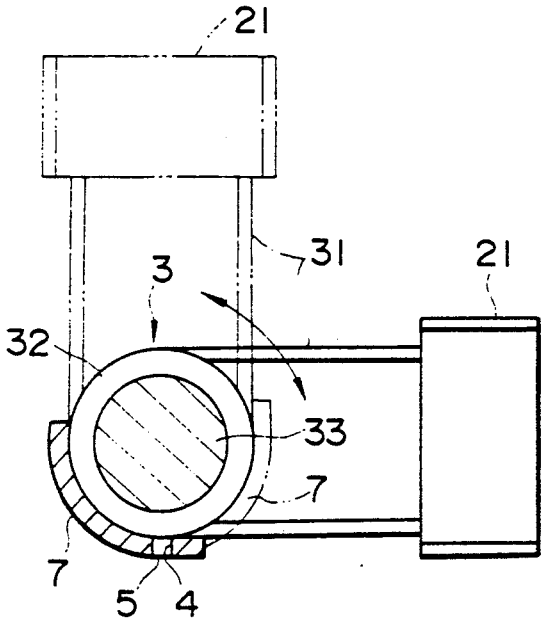
FIG. 14 is an enlarged cross section taken along the line Y—Y in FIG. 13.
Figure 15:
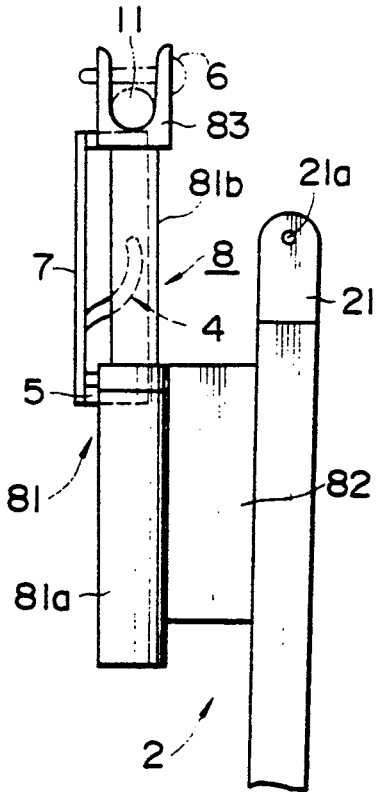
FIG. 15 is a side view of an essential part of a fourth preferred embodiment.
Figure 16:
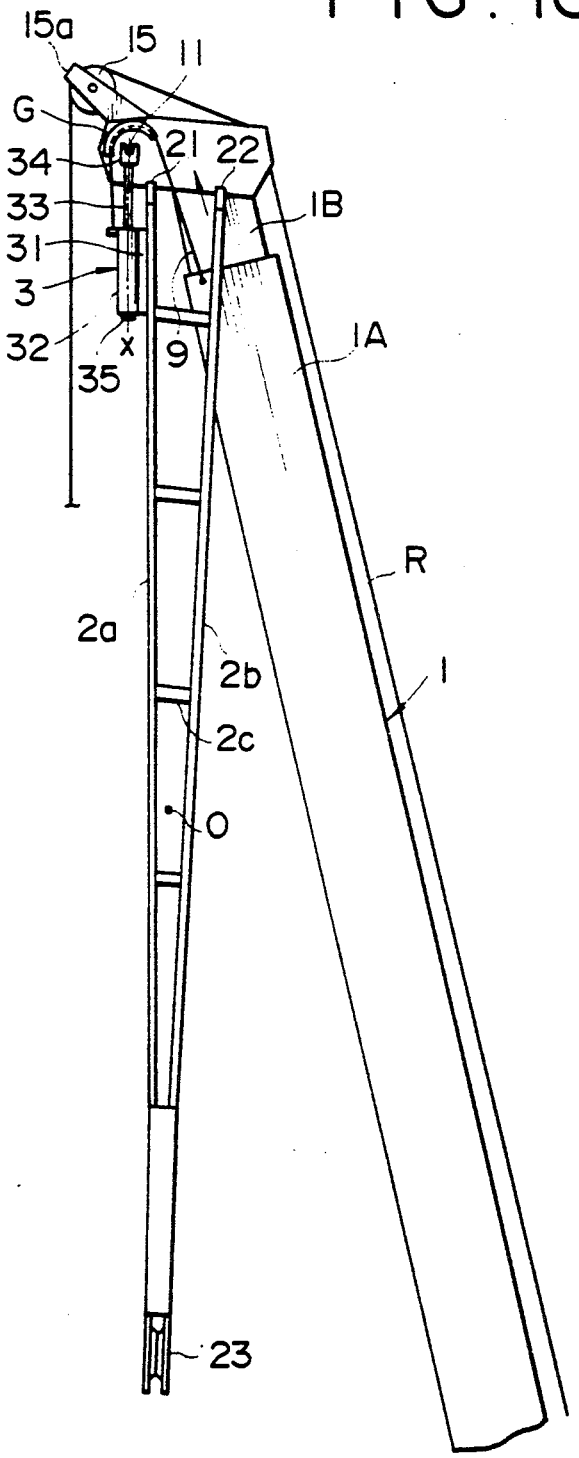
FIG. 16 is a view similar to FIG. 2, showing a fifth preferred embodiment.
Figure 17:
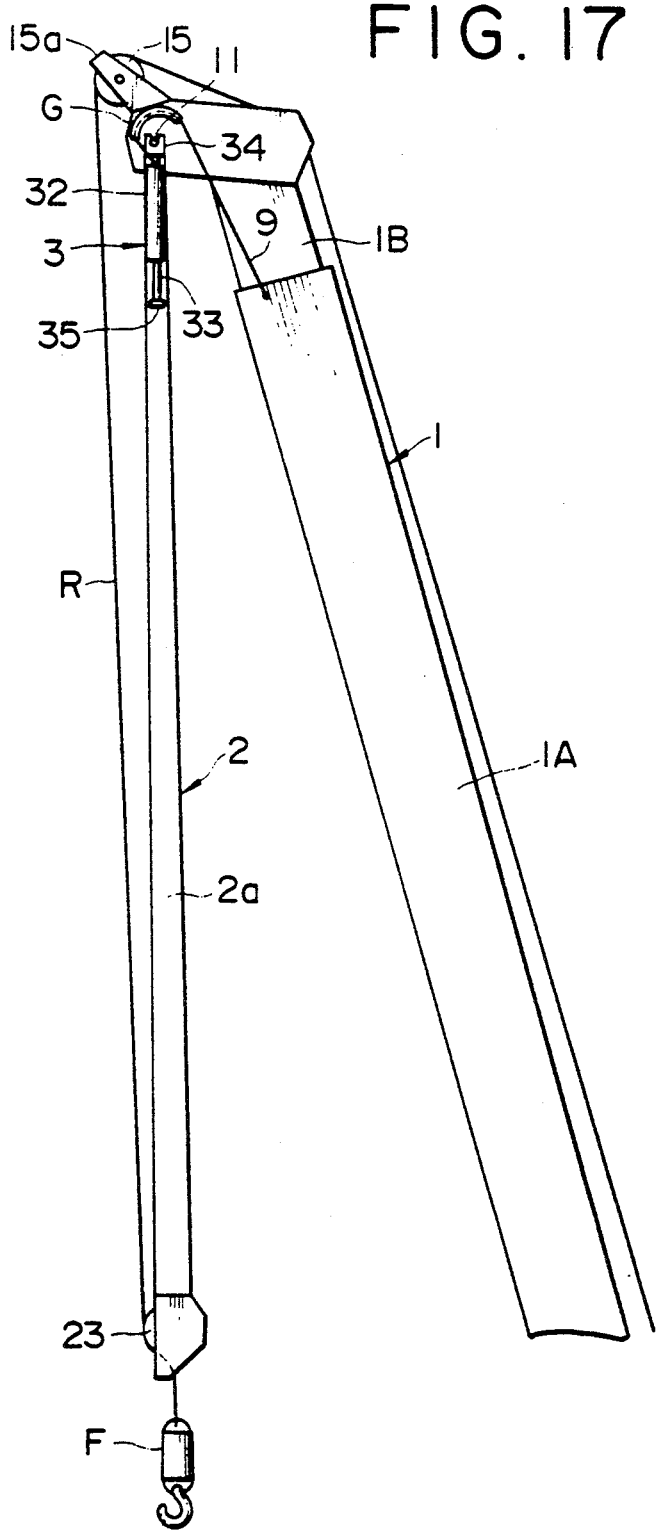
FIG. 17 is a view similar to FIG. 4, showing the fifth preferred embodiment.

To cope with this, the third preferred embodiment is constructed in such that an arcuate guide plate 7 formed with the twist guiding groove 4 is fixedly mounted on the outer circumferential surface of the housing 32 in such a manner as to extend upwardly from the housing 32 toward the connecting member 34 as viewed in FIG. 13, and that the guide pin 5 engaging with the twist guiding groove 4 projects from the outer circumferential surface of the connecting rod 33 at the upper portion thereof. As shown in FIG. 14, the twist guiding groove 4 is formed in an angular range of about 90°, and the arcuate guide plate 7 has an arcuate angle of 90° and little more. In case of forming the groove 4 in an angular range of about 270°, the arcuate angle of the arcuate guide plate 7 is set to 270° and little more. The other construction is the same as in the first preferred embodiment.

With this construction, the arcuate guide plate 7 may be formed by cutting a flat plate to form the guiding groove 4 and then arcuately bending the flat plate. Accordingly, the formation of the groove 4 can be easily carried out to thereby reduce a machining cost. Further, as compared with the case where the guiding groove 4 is formed on the outer circumferential surface of the connecting rod 33, it is not necessary to increase the diameter of the connecting rod 33, thus reducing the weight of the rod 33.

Alternatively, the guide plate 7 may be fixed to the connecting member 34 in such a manner as to extend downwardly from the connecting member 34 toward the housing 32, and the guide pin 5 may project from the outer circumferential surface of the housing 32 at the upper end portion thereof.

(4) FOURTH PREFERRED EMBODIMENT (SEE FIG. 15)

In each of the aforementioned preferred embodiments, the jib 2 is raised by taking up the whip rope R. However, as an axis of the whip rope R does not coincide with the axis of the auxiliary connector 3, a torque is applied to the jib in the jib raising step to render the raising operation of the jib 2 unstable.

To cope with this, the fourth preferred embodiment is constructed in such that a hydraulic cylinder 81 is used to form an auxiliary connector 8 which also serves as the jib raising/lowering means of the present invention.

More specifically, the hydraulic cylinder 81 includes a cylinder tube 81*a* as the housing of the present invention mounted through a bracket 82 to the jib 2, and a piston rod 81*b* as the connecting rod of the present invention. A connecting member 83 is connected to an end of the piston rod 81*b*. The arcuate guide plate 7 having the twist guiding groove 4 (formed in an angular range of about 90° or about 270°) is fixedly mounted on the connecting member 83 in such a manner as to extend downwardly from the connecting member 83 to the cylinder tube 81*a*. The guide pin 5 engaging the twist guiding groove 4 projects from the outer circumferential surface of the cylinder tube 81*a* at the upper end portion thereof. Thus, the twisting step and the raising/lowering step of the jib 2 are effected by the expanding/contracting operation of the hydraulic cylinder 81. The other construction is the same as in the first preferred embodiment.

With this construction, since a jib raising force is applied on the axis of the auxiliary connector 8, the raising operation of the jib 2 can be made smoother and more stably as compared with the case of using the whip rope R for the jib raising/lowering means.

(5) FIFTH PREFERRED EMBODIMENT (SEE FIGS 16 AND 17)

In the fifth preferred embodiment, a suspension rope 9 is used as the jib raising/lowering means of the present invention rather than the wire rope R.

The suspension rope 9 is wound on an arcuate rope guide member G (which may be replaced by a sheave mounted at the forward end of the movable boom 1B). It is fixed at its one end to the forward end of the base boom 1A and fixed at the other end to the housing 32 of the auxiliary connector 3. The other construction is the same as in the first preferred embodiment.

With this construction, when the boom 1 is expanded in the jib stretching operation, or the boom 1 is contracted from the expanded condition in the jib folding operation, a jib raising or lowering force is applied through the suspension rope 9 to the housing 32, that is, the jib 2, thereby automatically twisting the jib 2 as raising or lowering the same.

In the fifth preferred embodiment as well as the fourth preferred embodiment, the swinging-up or swinging-down step of the jib 2 is effected by the whip rope R and the hook F in the same manner as the first preferred embodiment.

The fifth preferred embodiment can exhibit an effect basically similar to that of the first preferred embodiment.

Although the twist guiding groove is formed on the outer circumferential surface of the connecting rod 33 in the fifth preferred embodiment as similar to the first and second preferred embodiments, the arcuate guide plate 7 as mentioned in the third and fourth preferred embodiments may be used in the fifth preferred embodiment.

(6) THE OTHER MODIFICATIONS (a) As a modification of the first and second preferred embodiments, the guide pin (engagement projection) 5 may be provided on the connecting rod 33, and the twist guiding groove 4 may be formed on the housing 32.

(b) Although the twist guiding groove 4 in the aforementioned preferred embodiments has the first straight groove portion 42 so as to prevent twisting of the jib 2 in the jib drawing step after the jib twisting step in the jib folding operation, the first straight groove portion 42 may be eliminated. Even in this case, the object of the present invention can be satisfactorily achieved.

(c) Although the forked connecting member 34 (83) is used as the means for connecting the end of the connecting rod 33 (the piston rod **81*b*) to the jib mounting shaft 11, the end of the connecting rod 33 (the piston rod 81*b*) may be suitably shaped so as to be detachably connected to the jib mounting shaft 11**.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A jib stretching and folding device for a crane comprising:

a boom having a forward end portion with opposite side surfaces, said forward end portion being provided with first and second jib mounting shafts projecting oppositely from said opposite side surfaces of said forward end portion;

a jib having a base end portion provided with first and second jib feet adapted to be detachably connected to said first and second jib mounting shafts, respectively; said jib having a folded condition wherein said jib is positioned next to a side surface of said boom and said first jib foot is positioned under said second jib foot; said jib also having an extended condition wherein said jib extends forwardly from said foward end portion of said boom and said first and second jib feet are connected to said first and second respective jib mounting shafts;

a lower surface formed on said jib;

an auxiliary connector mounted on said lower surface of said jib in the vicinity of said base end portion of said jib, said auxiliary connector comprising a cylindrical housing fixed to said lower surface of said jib and a connecting rod rotatably supported by said housing so as to be rotatable about an axis of said connecting rod, said axis being substantially parallel to said lower surface of said jib and said jib being pivotable and movable along said axis of said connecting rod; said jib having a transitional suspended condition wherein said jib is suspended by said connecting rod from a connection point between said connecting rod and said first jib mounting shaft;

means for twisting said jib by a predetermined jib twisting angle while said jib is in said transitional suspended condition;

jib raising/lowering means for selectively raising or lowering said jib by a predetermined raising or lowering quantity while said jib is in said suspended condition to connect or disconnect said first jib foot and said first jib mounting shaft and to connect or disconnect said second jib and said jib mounting shaft;

a twist guiding groove provided on one of said housing and said connecting rod of said auxiliary connector; and an engagement projection provided on the other of said housing and said connecting rod adapted so as to engage with said twist guiding groove, said twist guiding groove comprising a spiral groove portion extending in a direction corresponding to a twisting direction of said jib and formed in a circumferential angular range corresponding to said predetermined twisting angle, said twist guiding groove further comprising a straight groove portion having a length corresponding to the raising or lowering quantity of said jib; wherein said jib raising/lowering means causes said engagement projection to move relative to said twist guiding groove.

2. The jib stretching and folding device as defined in claim 1, wherein said twist guiding groove is provided on an arcuate guide plate on either said housing or said connecting rod of said auxiliary connector, and wherein the engagement projection is provided on the other of said housing and said connecting rod.

3. The jib stretching and folding device as defined in claim 2, wherein the auxiliary connector includes a hydraulic cylinder, the cylindrical housing includes a cylinder tube, said connecting rod includes a piston rod;

and wherein said jib raising/lowering means includes the hydraulic cylinder.

4. The jib stretching and folding device as defined in claim 1, wherein said twist guiding groove is formed on an outer circumferential surface of said connecting rod, and wherein said engagement projection is fixedly mounted to said housing so as to be insertable through a cylindrical wall of said housing.

5. The jib stretching and folding device as defined in claim 1, wherein the circumferential angular range corresponding to the predetermined twisting angle of the jib is about 270°, and wherein said twist guiding groove includes first and second straight portions continuously extending from opposite ends of said spiral groove portion.

6. The jib stretching and folding device as defined in claim 1, wherein the circumferential angular range corresponding to the predetermined twisting angle of the jib is about 90°, and the straight groove portion comprises first and second straight portions continuously extending from opposite ends of said spiral groove portion.

7. The jib stretching and folding device as defined in claim 2, wherein said arcuate guide plate is fixed to an outer circumferential surface of said housing in such a manner as to extend toward an end of said connecting rod, and said engagement projection projects from an outer circumferential surface of said connecting rod at a position near the end of said connecting rod.

8. The jib stretching and folding device as defined in claim 2, wherein said arcuate guide plate has an arcuate angle of slightly more than 90°, said spiral groove portion is formed in the circumferential angular range of about 90°, and said twist guiding groove includes first and second straight portions continuously extending from opposite ends of said spiral groove portion.

9. The jib stretching and folding device as defined in claim 2, wherein said arcuate guide plate has an arcuate angle of slightly more than 270°, said spiral groove portion is formed in the circumferential angular range of about 270°, and said twist guiding groove includes first and second straight portions continuously extending from opposite ends of said spiral groove portion.

10. The jib stretching and folding device as defined in claim 2, wherein said arcuate guide plate is formed by cutting a flat plate to form said twist guiding groove and then arcuately bending said flat plate.

11. The jib stretching and folding device as defined in claim 3, further comprising a connecting member fixed to an end of said piston rod and adapted to be connected to said first jib mounting shaft, wherein said arcuate guide plate is fixed to said connecting member in such a manner as to extend toward said cylinder tube, and said engagement projection projects from an outer circumferential surface of said cylinder tube at a position near an end of said cylinder tube.

12. The jib stretching and folding device as defined in claim 3, wherein said arcuate guide has an arcuate angle of slightly more than 90°, said spriral groove portion is formed in the circumferential angular range of about 90°, and said twist guiding groove comprises first and second straight portions continuously extending from opposite ends of said spiral groove portion.

13. The jib stretching and folding device as defined in claim 3, wherein said arcuate guide plate has an arcuate angle of slightly more than 270°, said spiral groove portion is formed in the circumferential angular range of about 270°, and said twist guiding groove comprises first and second straight portions continuously extending from opposite ends of said spiral groove portion.

14. The jib stretching and folding device as defined in claim 1, wherein said jib raising/lowering means comprises a whip rope having one end connected to a forward end of said jib.

15. The jib stretching and folding device as defined in claim 1, wherein said boom comprises a base boom pivotably supported at its base end to body of said crane and a movable boom telescopically supported by said base boom, and said jib raising/lowering means comprises a suspension rope having one end connected to a forward end of said base boom and the other end connected to said housing of said auxiliary connector.

16. The jib stretching and folding device as defined in claim 1, further comprising a bracket fixing said housing to said lower surface of said jib, and wherein said connecting rod is inserted through said housing in an axial direction thereof.

17. The jib stretching and folding device as defined in claim 1, further comprising a forked connecting member fixed to one end of said connecting rod and adapted to be connected to said first jib mounting shaft, and a stopper fixed to the other end of said connecting rod and adapted to abut against an end surface of said housing.

18. The jib stretching and folding device as defined in claim 17, wherein said forked connecting member is formed with a pair of pin holes for inserting a fixing pin thereinto, so as to connect said connecting member to said first jib mounting shaft disengageably and rotatably with respect thereto.

* * * * *